United States Patent [19]

Kornrumpf

[11] 4,281,372

[45] Jul. 28, 1981

[54] POWER SUPPLY FOR MAGNETRON AND THE LIKE LOADS

[75] Inventor: William P. Kornrumpf, Schenectady, N.Y.

[73] Assignee: General Electric Company, Schenectady, N.Y.

[21] Appl. No.: 86,826

[22] Filed: Oct. 22, 1979

[51] Int. Cl.[3] ..... H05B 6/68

[52] U.S. Cl. ..... 363/20; 219/10.55 B

[58] Field of Search ..... 219/10.55 B; 323/17, 323/22 T, DIG. 1; 315/86, 87; 363/20

[56] References Cited

U.S. PATENT DOCUMENTS

| | | | |
|---|---|---|---|
| 3,530,363 | 9/1970 | Schimke et al. | 363/20 |
| 3,609,512 | 9/1971 | Lewis | 323/22 T |
| 3,909,702 | 9/1975 | Hart | 323/22 T |
| 4,001,537 | 1/1977 | Burke et al. | 219/10.55 B |
| 4,027,200 | 5/1977 | Sahara et al. | 363/20 |
| 4,073,003 | 2/1978 | Chambers | 363/20 |

FOREIGN PATENT DOCUMENTS

| | | | |
|---|---|---|---|
| 52-16035 | 2/1977 | Japan | 219/10.55 B |

*Primary Examiner*—A. D. Pellinen

*Attorney, Agent, or Firm*—Geoffrey H. Krauss; James C. Davis; Marvin Snyder

[57] ABSTRACT

A flyback-type high-frequency, high-voltage power supply for energizing a self-rectifying load, such as a magnetron microwave power generator for a microwave oven and the like. A switching device is connected in series with a primary winding of a transformer to provide pulses of energy to a self-resonant circuit at the transformer secondary winding. The self-resonant circuit includes the electrical capacitance of the load connected across the transformer secondary winding. The load conducts only for unipolarity excitation exceeding a minimum magnitude. A clamping diode is positioned in parallel with the switching device, at the transformer primary winding, to protect the switching device from reverse-voltage effects. A high-voltage rectifier is not required in this relatively light-weight power supply.

10 Claims, 5 Drawing Figures

+V
-V'
17
15a
15
15c
15b
20
17a''
17a
17a'
C2
42
C3
D1
C4
R1
40
C5
45a
45
45b
R2
66c
66
66b
41
R3
47b
47
47a
45c
D2
42
R16
66a
R17
A
D3
47c
R18
R19
68c
68a
68b
68
R4
C6
C7
50
R8
63a
63
63c
50a
50b
50c
63b
58
D6
R15
62
64a
62a
64c
64
R14
62b
62c
R13
64b
D4
61c
61
61a
R10
61b
R12
C8
D5
R11
60a
60
60c
60b
R9
R6
R7
52
52a
52b
54
56
17b'

POWER SUPPLY FOR MAGNETRON AND THE LIKE LOADS

BACKGROUND OF THE INVENTION

The present invention concerns power supplies and, more particularly, a self-resonant power supply of the flyback type which does not require a high-voltage rectifier for supplying operating energy to a microwave oven magnetron and the like loads.

Magnetron microwave generators are becoming more widely used in food preparation appliances, such as microwave ovens and the like. The power supply utilized in many presently available microwave ovens typically utilizes a high-reactance voltage step-up transformer and a voltage doubler. Typically, a capacitance is in series between the transformer secondary winding and the load, and a voltage-doubling diode is across the anode-cathode circuit of the magnetron to provide a voltage-doubled, half-wave current supply for the magnetron. A rectified sinewave portion of operating current is applied to the magnetron at a repetition rate equal to the line frequency, e.g. 60 Hertz (Hz.). These relatively-low-frequency power supplies are of relatively great weight and require additional structural strength in the microwave appliance to protect against physical damage during shipment and use. Additionally, the typical magnetron power supply is of relatively great manufacturing cost. It is desirable to not only reduce the cost and weight of the magnetron power supply, but also to more easily control the amount of energy being supplied to the microwave-power-generating magnetron to provide greater control of the food preparation sequences achievable therewith.

BRIEF SUMMARY OF THE INVENTION

In accordance with the invention, a power supply for energizing a magnetron and the like self-rectifying load, through which a current flows only when a predetermined minimum voltage of a single polarity is exceeded thereacross, comprises a transformer having a primary winding in series between a controlled-current-path through a switching device, and a source of operating voltage, as may be provided by rectifying the power line voltage and the like. A secondary winding of the transformer connects across the load. An electrical capacitance across the inductance of the primary winding is of a magnitude sufficient to resonate the transformer winding at a frequency greater than the frequency of a driving signal applied to a controlling element of the switching device. A device having unidirectional current-flow characteristics is connected in parallel with the controlled-current circuit of the switching device to prevent application of voltages of improper polarity across the switching device during half-cycles of oscillatory voltage, present at the primary winding of the transformer due to the resonance effect. The frequency and/or duty cycle of the controlling signal, to the controlled switching device, is varied to vary the amount of current drawn by the load device, such as a magnetron and the like, and thus control the amount of power consumed (and the microwave power generated thereby).

In one presently preferred embodiment, the resonating capacitance is provided by filament bypass capacitance coupled from the magnetron filament, itself connected to an end of the high voltage secondary of the transformer, to electrical ground potential. In other presently preferred embodiments, a resonating capacitance is connected in parallel with the controlled-current-circuit of the switching device and is of magnitude selected to resonate with the inductance appearing at the primary winding of the high voltage transformer; the total capacitance across the winding inductance may be the sum of the resonating capacitance across the primary winding and the load capacitance reflected from the secondary winding back to the primary winding.

Accordingly, it is an object of the present invention to provide a resonant power supply for energizing a load consuming power only if a minimum voltage thereacross is exceeded.

This and other objects of the present invention will become apparent upon consideration of the following detailed description, when taken in conjunction with the drawings.

DETAILED DESCRIPTION OF THE INVENTION

Figure 1:
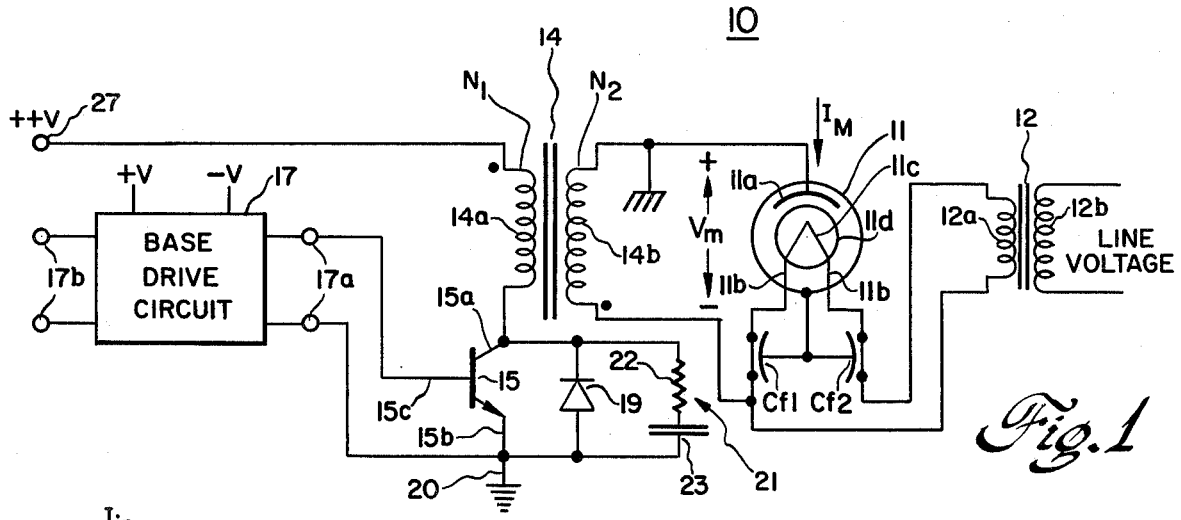
FIG. 1 is a schematic diagram of a microwave oven magnetron and of a power supply therefor, in accordance with the principles of the present invention.

Referring initially to FIG. 1, a power supply 10 for energizing a load, such as microwave oven magnetron 11 and the like, provides a voltage $V_M$ across the load magnetron, with positive polarity at a magnetron anode 11*a* coupled to electrical ground potential, and with negative polarity at one of a pair of leads 11*b* of a magnetron filament 11*c* serving to heat a magnetron cathode 11*d* for emission of electrons therefrom. The magnetron filament leads 11*b* are connected to the ends of a secondary winding 12*a* of a filament transformer 12 having its primary winding 12*b* connected to the power line voltage, typically on the order of 115 volts A.C. at 60 Hz. As is well known, upon application of an electrical potential between magnetron anode 11*a* and magnetron cathode 11*d*, of a magnitude greater than some minimum potential, typically on the order of three to four kilovolts (kV.), the magnetron draws anode current $I_M$ and produces microwave power which is output from the generator 11 to, inter alia, cook food and the like in a microwave oven and the like. Presently, a typical power supply for supplying operating current to magnetron 11 would include a 60 Hz. high-voltage step-up transformer having a high-voltage capacitor in series between one end of the high-voltage secondary winding and the magnetron, and a high-voltage doubler diode in parallel with the magnetron. This form of power supply (not shown) typically operates at the 60 Hz. line frequency and is characterized by a relatively heavy and expensive transformer, as well as relatively expensive high-voltage capacitor and diode components.

Power supply 10 operates at a frequency typically two to three orders of magnitude greater than the line frequency, e.g. between about 20 kHz. and about 100 kHz., whereby the weight of a transformer 14, utilized for voltage step-up purposes, is reduced. Power supply 10 does not require either a high-voltage, voltage-doubler capacitor or a high-voltage diode. A primary winding 14*a* of high-voltage transformer 14 is connected between a source of voltage of magnitude ++V and the controlled-current-flow circuit of a switching device 15. The operating voltage of magnitude ++V may be obtained by rectification of the 115 volts 60 Hz. line voltage and may thus be of magnitude on the order of 170 volts D.C. peak. In my preferred embodiment, controlled switching device 15 is a transistor having: a collector electrode 15*a* coupled to the remaining end of transformer primary winding 14*a;* an emitter electrode 15*b* coupled to electrical ground potential; and a base electrode 15*c*, into which a flow of current controls the current flowing through the collector-emitter circuit of transistor 15, and hence through primary winding 14*a*, during at least a portion of a power supply cycle. A base drive circuit 17 receives one, or more, operating potentials (±V) of relatively low magnitude, on the order of 5–15 volts D.C., to provide an output 17*a* coupled between the base and emitter electrodes of switching device 15 for providing the current-controlling signal thereto. The input 17*b* of the base drive circuit receives a relatively low-power signal serving to establish the timing characteristics of the base electrode drive to the switching device and therefor the magnitude of microwave produced by magnetron generator 11.

A clamping diode 19 has its cathode electrode connected to the junction between primary winding 14*a* and switching device collector electrode 15*a*, and has its anode electrode connected to switching device emitter electrode 15*b* and electrical ground 20. A snubbing network 21, comprised of a resistance 22 in series of an electrical capacitance 23, is connected in electrical parallel across diode 19 and the controlled-current-flow circuit (from collector 15*a* to emitter 15*b* of device 15).

In the embodiment of FIG. 1, magnetron filament leads 11*b* are coupled through electromagnetic-interference-suppressing bypass capacitors $C_{f1}$ and $C_{f2}$, each having a capacitance chosen to provide a total capacitance C across secondary winding 14*b* to resonate the secondary winding 14*b* at a resonant frequency greater than the operating frequency, which is between about 20 kHz. and about 100 kHz. Transformer 14 is a voltage step-up transformer having $N_1$ primary winding turns and $N_2$ secondary turns, where $N_2$ is greater than $N_1$.

Figure 2:
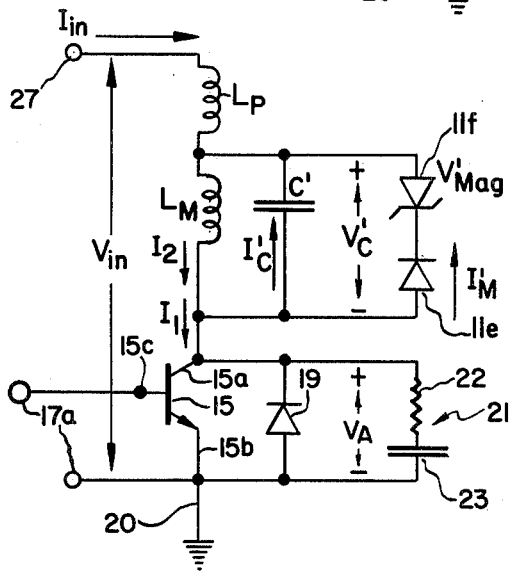
FIG. 2 is a schematic diagram of the equivalent circuit of a portion of the power supply of FIG. 1 and useful in understanding the operation thereof.
Figure 3:
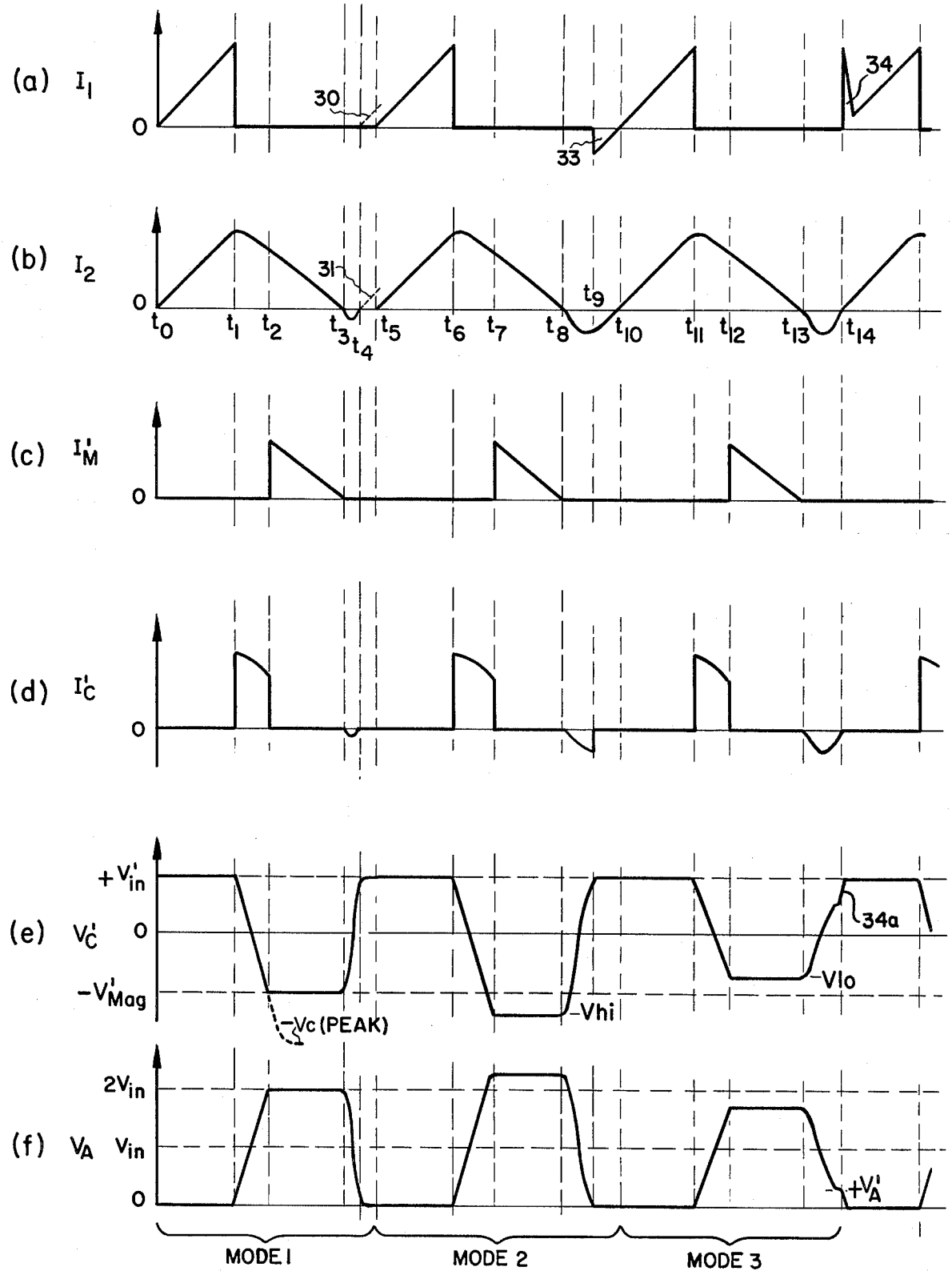
FIG. 3 is a set of interrelated current and voltage waveforms from the simplified circuit of FIG. 2, and useful in understanding operational principles of the present invention.

Referring now to FIGS. 1, 2 and 3, operation of the high-voltage portion of power supply 10 may be better understood by considering the equivalent circuit (FIG. 2) of the load magnetron, as reflected to the primary winding side of transformer 14. As previously mentioned hereinabove, current flows through the magnetron only if the magnetron anode is positive with respect to the magnetron cathode and only if the voltage from anode to cathode of the magnetron exceeds some minimum voltage. Thus, the magnetron appears to be a series circuit including a diode 11*e* having its anode connected to the magnetron anode and having its cathode connected to the anode of a high-voltage zener diode 11*f*, of zener voltage equal to the minimum magnetron voltage $V_{mag}'$, and having its cathode connected to the cathode of the magnetron. The magnetron circuit capacitance appears from anode to cathode of the magnetron and in parallel with the series diode-zener diode circuit. When reflected from the secondary winding 14*b* to primary winding 14*a*, the magnetron equivalent circuit appears as an equivalent capacitance C' in parallel with the magnetron diode circuit, including series diode 11*e* and series zener diode 11*f*, all in electrical parallel connection with the mutual inductance $L_M$ of the transformer. The magnitude C' of the reflected resonating capacitor is equal to the resonating capacitance C times the square of the ratio of turns of the secondary winding to the turns of the primary winding, i.e. $C'=C(N_2/N_1)^2$. The reflected minimum magnetron zener voltage $V_{Mag}'$ is equal to the minimum magnetron voltage $V_{Mag}$ times the stepdown ratio of the turns of the primary winding to the turns of the secondary winding i.e. $V_{Mag}'=-V_{Mag}(N_1/N_2)$. A primary winding self-inductance $L_P$ (of magnitude much smaller than the mutual inductance $L_M$) is in series between the mutual inductance of the primary winding and the operating voltage potential ++V at terminal 27. The opposite end of mutual inductance $L_M$ is connected to the collector of transistor 15, at which point are connected the cathode of diode 19 and one end of snubber network 21. The remaining end of network 21, diode 19 and the emitter electrode 15*b* of switching device 15 are connected to the common (or ground potential) terminal 20.

Operation of the resonant fly-back power supply is as follows: Assume initially that the minimum magnetron voltage $V_{Mag}$ is equal to $V_{in}(N_2/N_1)$; therefor $V_{Mag}'=-V_{in}$. Prior to some time $t_o$, capacitance C' has been charged to the input voltage $V_{in}$. The voltage $V_c'$ is equal to $V_{in}$ (FIG. 3, waveform e). There is no current $I_2$ flowing through the mutual inductance $L_M$ (FIG. 3, waveform b). When base drive circuit 17 supplies a current signal of sufficient magnitude into base electrode 15*c*, transistor 15 is driven into the heavily-conducting condition, whereby a substantially short circuit appears between collector electrode 15*a* and emitter electrode 15*b*. In this condition, substantially the entire operating voltage $V_{in}$ appears across the transformer primary winding 14*a*. Input current $I_{in}$ flows from operating potential terminal 27 sequentially through the primary winding inductance $L_P$ and the mutual inductance $L_M$. The voltage across the mutual inductance is such that the magnetron is reverse-biased and therefore diode 11*e* is also reverse-biased, whereby the magnetron current $I_M'$ (being the magnetron current $I_M$ reflected through the transformer to primary winding 14*a*) is substantially zero, as the magnetron does not conduct. The current $I_1$ (FIG. 3, waveform a) increases linearly, between time $t_0$ (when switching device 15 is initially placed in the on condition), and time $t_1$ (when device 15 is turned off, as by removing drive to base electrode 15*c*). During the same time interval, the current $I_2$ through magnetizing inductance $L_M$ is also linearly increasing and is of magnitude substantially identical to the current $I_1$ flowing into switching device collector electrode 15*a*, as the current $I_C'$ (FIG. 3, waveform d) flowing through the reflected resonating capacitance C' is substantially zero and the reverse-biased magnetron current $I_M'$ (FIG. 3, waveform c) is also substantially zero. The shape of the $I_2$ waveform obtains from the condition that $(dI_2/dt=V_{in}/L_M)$. During the time interval $t_0-t_1$, the voltage $V_C'$, across reflected resonating capacitor C', remains substantially equal to the operating potential $V_{in}$ (waveform e of FIG. 3), while, as previously mentioned hereinabove, the collector voltage $V_A$ (waveform f of FIG. 3) across switching device 15 is substantially equal to zero volts.

At time $t_1$, switching device 15 turns off and the energy stored in mutual inductance $L_M$ is transferred to the secondary winding. Current $I_1$ falls to zero, as device 15 is now in the open, or non-conducting, condition. Current $I_2$, through mutual inductance $L_M$, cannot abruptly change. As the magnetron load is not conducting, the mutual inductance current $I_2$ must flow as capacitance current $I_C$, into the equivalent reflected capacitance C'. Thus, at time $t_1$, current $I_C'$ suddenly jumps from an essentially zero current flow to a peak current flow proportional to the value of the current $I_2$ flowing in the mutual inductance immediately prior to the turning-off of transistor 15. The current $I_C'$ flows into capacitance C' and sinusoidally charges the capacitance toward a peak voltage $V_C'$ (Peak)$=\sqrt{L_M I_2^2\text{(peak)}/C'}$ (FIG. 3, waveform e). The capacitor voltage $V_C'$ continues to charge in the negative direction until this voltage, which is also the voltage across reflected magnetron cathode-anode circuit, reaches the equivalent minimum voltage ($-V_{Mag}'$) at the magnetron cathode. Magnetron diode 11e now conducts and a flow of magnetron current $I_M'$ commences. At this time $t_2$, essentially all of the mutual inductance current $I_2$ is drawn by the magnetron load, and the capacitance charging current $I_C'$ (FIG. 3, waveform d) falls to zero. The decreasing magnitude of mutual inductance current $I_2$ (FIG. 3, waveform b) is the decreasing magnitude of the magnetron load current $I_M$ and, during the time interval from time $t_2$ (when the magnetron begins to conduct) until a time $t_3$ (when the magnetron current reaches zero) is a substantially linearly decreasing current given by the condition ($dI_M'/dt=V_{Mag}'/L_M$). During the time interval $t_2-t_3$, the voltage $V_C'$ across the equivalent capacitance is held essentially at the magnetron equivalent zener voltage, which, as previously stated hereinabove, is equal in magnitude to the magnitude of the input voltage $V_{in}$. The voltage $V_A$ across the open collector-emitter circuit of transistor 15 is equal to the sum of the input voltage $V_{in}$ plus the equivalent capacitance voltage $V_C'$. $V_C'$ is now equal in magnitude to the input voltage $V_{in}$, by the initial assumption for the turns ratio of the transformer. Thus, the maximum collector-emitter voltage which device 15 must sustain is equal to twice the supply potential ($V_{in}$), as seen in FIG. 3, waveform f.

At time $t_3$, the energy stored in mutual inductance $L_M$ falls to zero, whereby the mutual inductance current $I_2$ is equal to zero. The magnetron current $I_M'$ also is essentially of zero magnitude and the magnetron ceases conduction. However, the voltage $V_C'$ across equivalent capacitance C' is still equal to the equivalent magnetron load voltage $-V_{Mag}'$, whereby the equivalent capacitance now pumps stored charge back into the mutual inductance, with the mutual inductance current $I_2$ having a negative polarity (current flow in the direction opposite to the direction of arrow $I_2$). The equivalent capacitance voltage $V_C'$ rises toward zero volts, and, as the current $I_2$ now flowing through the mutual inductance must remain continuous, the effective capacitance and mutual inductance "ring." The effective capacitance C' begins to sinusoidally charge toward a voltage $V_C'$ equal to the input voltage $V_{in}$. The device collector-emitter voltage $V_A$ (which is equal to the input voltage $V_{in}$ minus the capacitance voltage $V_C'$) falls until, at time $t_4$, voltage $V_A$ is equal to zero volts (when capacitance voltage $V_C'$ is equal to $+V_{in}$ volts). At time $t_4$, all of the currents $I_1$, $I_2$, $I_M'$ and $I_C'$ are essentially equal to zero, while the equivalent capacitance voltage $V_C'$ is equal to the input voltage $V_{in}$ and the device collector-emitter voltage $V_A$ is essentially zero volts. Switching device 15 is again turned on at time $t_4$ (see $I_1$ and $I_2$ curves (broken lines 30-31)) to restart the cycle, at which time the capacitance voltage $V_C'$ is indeed equal to the input voltage $V_{in}'$, as was the initial assumption. The cycles are repeated for as long a time interval as magnetron output is desired.

In the event that magnetron 11 does not draw current after time $t_1$, as might be caused by lack of power to filament 11c, the current stored in the magnetizing inductance is pumped into the equivalent capacitance C' and a sinusoidal oscillation starts. However, as soon as the voltage $V_C'$ across the equivalent capacitance reaches a value equal to $-V_{in}$, catching diode 19 is forward biased and draws current from the mutual inductance-effective capacitance circuit to ground potential, at terminal 20, until the effective capacitance voltage returns to a value of $+V_{in}$ and another cycle of power supply may commence. If the load magnetron conducts during a subsequent power supply cycle, operation is as described hereinabove, while if the magnetron still does not conduct, the beginning of an oscillatory current condition again occurs and catching diode 19 again conducts until the capacitance voltage is equal to the input voltage.

It will be seen that: transformer 14 should have a relatively low primary leakage inductance $L_p$ to avoid potentially destructive high-voltage spikes from appearing across the power transistor at turn-off; catching diode 19 functions to protect the collector-emitter circuit of device 15 from application of negative polarity voltages $V_A$ thereacross; and snubber circuit 21 protects against high positive voltge spikes at the transistor collector when the transistor is turned off. Similarly, the required peak voltage and current ratings of switching device 15 are determined from the peak magnetron current, operating potential and transistor turn-on and turn-off characteristics. In the event of failure of the magnetron to conduct, switching device 15 is protected from negative collector voltages, with respect to the emitter electrode 15b thereof, by means of diode 19, which would then be forward biased and would be rated to conduct a peak fault current equal to the maximum current $I_1$ conducted by switching device 15 during the energy-storage portion of the cycle, e.g. in the time interval $t_0-t_1$. It will also be seen that the magnetron output power can be varied by varying the time interval $t_0-t_1$, to control the magnitude of $I_2$ (peak) in mutual inductance $L_M$, and therefore the peak magnitude of $I_M$. A larger or shorter time interval $t_0-t_1$ will increase or decrease, respectively, the amplitude of $I_2$ (peak) and the peak value of $I_M$.

In the foregoing, illustrated as MODE 1 of power supply operation, the reflected magnetron voltage $V_{Mag}'$ (being the magnetron voltage $V_{Mag}$ reflected back through the transformer to the primary winding and therefore equal to the magnetron voltage divided by the turns ratio of the transformer) is assumed essentially equal to the magnitude $V_{in}$ of the operating voltage. However, all magnetrons will not have essentially identical operating voltages $V_{Mag}$, at which voltage current conduction therethrough occurs. It is desirable to have a single power supply configuration which can be utilized without adjustment in conjunction with loads having somewhat greater, or somewhat lesser, voltages at which current conduction occurs. In MODE 2, and MODE 3, respectively, the minimum load conduction voltages are respectively greater than, and less than, the nominal design value, i.e. the MODE 1 value, and accordingly the value of equivalent magnetron zener voltage $V_{Mag}'$, as reflected through transformer 14 to the primary winding thereof, is respectively greater than, and less than, the value of operating voltage $V_{in}$.

In MODE 2, the same initial conditions (capacitance C' charged to $+V_{in}$ volts and mutual inductance current $I_2$ equal zero) are assumed as in MODE 1. The portion of each cycle from the initial transistor 15 turn-on time $t_5$ to cessation-of-magnetron-current-flow time $t_8$ occurs in substantially the same manner as the operation during the time interval $t_0-t_3$ of MODE 1. The only difference is that, due to the greater negative voltage ($-V_{hi}$) needed to begin magnetron current conduction, the MODE 2 time interval between $t_6$, when transistor 15 turns off, and time $t_7$, when the magnetron voltage has reached the minimum conduction voltage and current flow can begin, is somewhat longer than the associated $t_1-t_2$ time interval in the MODE 1 case. In MODE 2, the charge stored in equivalent capacitance C' causes the voltage $V_C'$ thereacross to ring from the negative voltage $-V_{hi}$ to the input voltage $V_{in}$, starting at time $t_8$ after the magnetron turns off. At time $t_9$, the voltage $V_C'$ across the capacitor has become equal to the supply voltage $V_{in}$ and forward biases catching diode 19. The catching diode 19 must conduct over the time interval from time $t_9$ to time $t_{10}$ to allow the remaining current stored in mutual inductance $I_M$ to flow through the now forward-biased catching diode 19 as current $I_1$ of negative magnitude (area 33 of waveform a of FIG. 3). Thus, during the time interval from time $t_9$ to $t_{10}$, the current $I_2$ in mutual inductance $L_M$ will decrease linearly with time, with a slope given by the condition ($dI_2/dt=V_{in}/L_M$). There will again be no current flow in the mutual inductance at time $t_{10}$. The effective capacitance C' will again be charged to the input voltage $V_{in}$, and the transistor 15 can again be turned on, at time $t_{10}$, to initiate another cycle of the flyback power supply. In both MODE 1 and MODE 2 the initial conditions are identical and switching device 15 is very lightly stressed as the device turns on with zero circuit current flow therethrough and turns off with essential zero voltage thereacross; only the energy in the transformer leakaged inductance must be dissipated by switching device 15, cathing diode 19 and snubber circuit 21.

In MODE 3, the switching device 15 is turned on at the beginning of a cycle at time $t_{10}$. A zero magnitude current flow exists at $t_{10}$ for currents $I_1$, $I_2$, $I_M'$ and $I_C'$; the effective capacitance voltage $V_C'$ is equal to the input voltage $V_{in}$, and, therefore, the voltage $V_A$ across the switching device has an essentially zero magnitude. The mutual inductance current $I_2$ increases linearly until device 15 is turned off at time $t_{11}$, when a pulse of capacitance current $I_C'$ occurs, as the voltage $V_C'$ across the capacitance falls. At time $t_{12}$ the voltage across the magnetron reaches the magnetron conduction voltage, which for the low-voltage case is the negative voltage $-V_{10}$. It should be understood that the time interval between time $t_{11}$ and time $t_{12}$ is somewhat less than the time interval between time $t_1$ and time $t_2$ in the MODE 1 case, as the voltage must reach a smaller negative magnitude. In the time interval from time $t_{12}$ to time $t_{13}$, magnetron current $I_M'$ flows and, as in the MODE 1 and MODE 2 cases, is a linearly decreasing current ramp, reaching essentially zero magnitude at time $t_{13}$. At time $t_{13}$, the charge stored in the equivalent capacitance initiates the resonance oscillation, and the voltage across the capacitance starts to rise. However, since the negative magnitude of capacitance voltage $V_C'$ was less negative than in the MODE 1 and MODE 2 cases, there is not sufficient energy stored in the equivalent capacitance C' to ring the capacitance voltage $V_c'$ back to the positive input voltage $+V_{in}$ to assume prior initial conditions by a time $t_{14}$ when all the stored charge has flowed from equivalent capacitance C', and at which time a turn-on signal drives switching device 15 into saturation. Thus, at time $t_{14}$, the voltage $V_A$ between the collector and emitter electrodes of the device is a non-zero voltage $V_A'$ and the switching device must conduct an initial spike 34 of current $I_1$ of magnitude sufficient to recharge the effective capacitance C' to the initial condition wherein the voltage $V_C'$ thereacross is raised, as at 34*a* in waveform e of FIG. 3, to the equal magnitude to the input voltage $V_{in}$ to begin the next flyback power supply cycle. This large switching-device current pulse increases the switching losses and indicates that the minimum load magnetron voltage $V_{10}$, of MODE 3, should be the equivalent magnetron voltage utilized in designing the turns ratio of transformer 14, whereby all magnetrons in a production run would have at least that minimum voltage and the flyback power supply will always operate in one of MODEs 1 and 2, and not in MODE 3.

Figure 4:
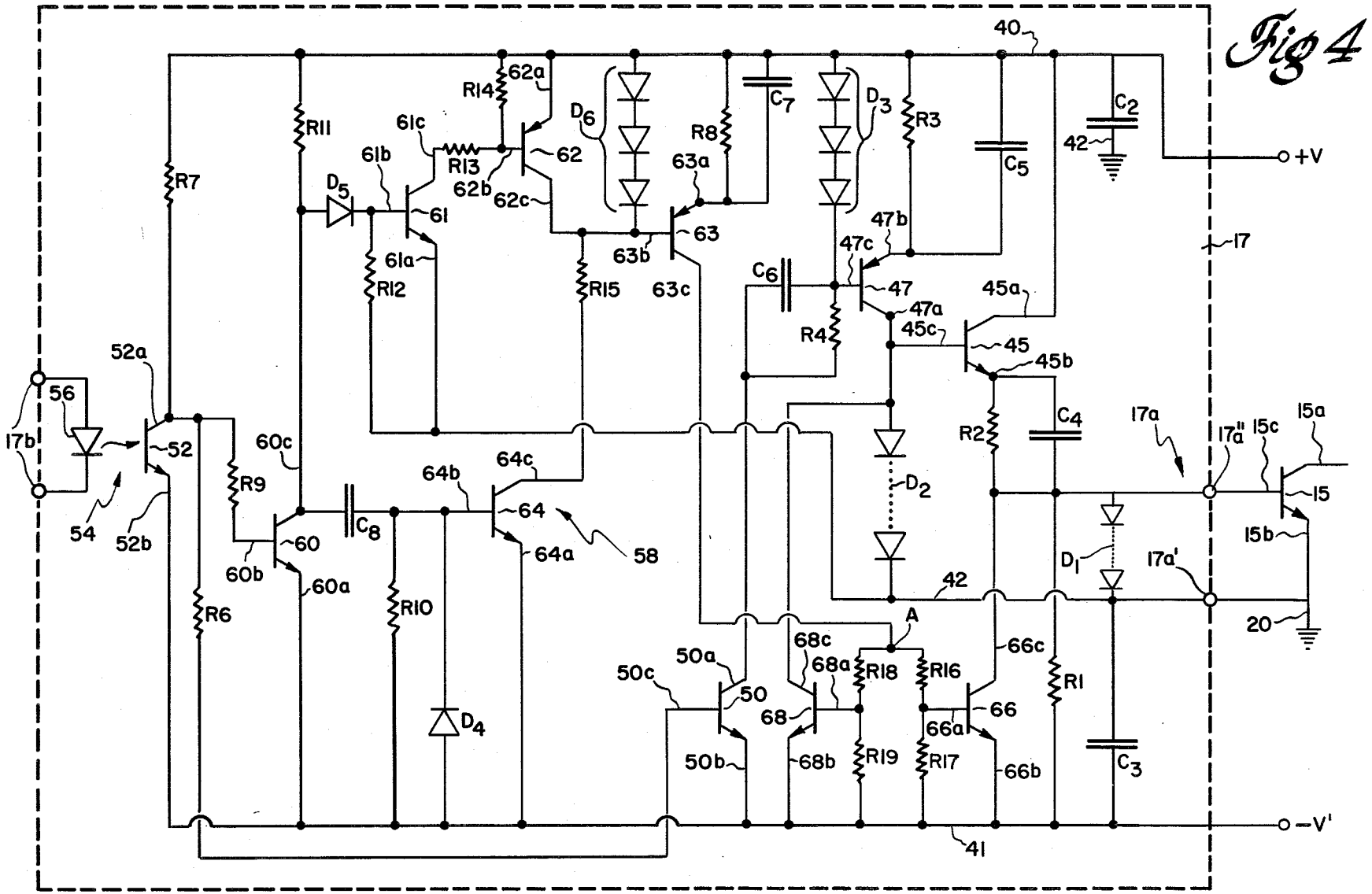
FIG. 4 is a schematic diagram of a base drive circuit suitable for use in the power supply of FIG. 1.

Referring now to FIG. 4, a presently preferred embodiment of base drive circuit 17 is illustrated. First and second sources of potential supply a positive potential rail 40 with a voltage of positive polarity and magnitude +V, while a negative potential rail 41 is supplied with an operating potential of negative polarity and another operating potential −V', which may be of the same or different magnitude as the magnitude V of the voltage on positive supply rail 40. One terminal 17*a*' of base drive circuit output 17*a* is connected to ground potential connection 20 at the emitter electrode 15*b* of the control transistor and to a ground potential bus 42, within base drive circuit 17. The base drive circuit output terminal 17*a*'' connected to switching device base electrode 15*c* is connected through a resistance $R_1$ to negative supply bus 41. A first diode string $D_1$, which in the illustrated embodiment consists of six series-connected diodes, is connected between the two terminals of base drive circuit output 17*a*. A capacitor $C_2$ is connected between positive potential bus 40 and ground bus 42, while another capacitor $C_3$ is connected between the ground bus and the negative potential bus 41, with each of the capacitors $C_2$ and $C_3$ providing a low-impedance, energy-storage filter for the positive and negative supplies, respectively.

A driver transistor 45 has its collector electrode 45*a* connected to positive supply bus 40 and has its emitter electrode 45*b* coupled to the controllable switching device base electrode 15*c*, via the parallel-connected combination of a resistance $R_2$ and a speed-up capacitor $C_4$. The base electrode 45*c* of driver transistor 45 is connected via a second string of diodes $D_2$, comprised of five diodes in the presently illustrated embodiment, to ground bus 42. Base electrode 45*c* is also connected to the collector electrode 47*a* of a first current-source transistor 47, having its emitter electrode 47*b* connected to positive supply bus 40 via the parallel combination of an emitter resistor $R_3$ and an emitter capacitor $C_5$. The base electrode 47c of current source transistor 47 is connected to positive supply bus 40 via a third diode string $D_3$ having a number of diodes chosen to determine the output current of the first current source, in conjunction with the emitter resistance $R_3$. Base electrode 47c is connected, via a paralleled resistance $R_4$ and a speed-up capacitor $C_6$, to the collector electrode 50a of a transistor 50. The emitter electrode 50b is connected to negative supply bus 41 and a base electrode 50c is connected through a resistance $R_6$ to the collector electrode 52a of a phototransistor 52 which forms part of an optoelectronic coupler 54. The phototransistor collector electrode 52a is also connected, via a collector resistor $R_7$, to positive supply bus 40. The emitter electrode 52b of the phototransistor is connected to negative supply bus 41. The optoelectronic coupler 54 also includes a light-emitting device (LED) 56 connected across base drive circuit input terminals 17b. A one-shot monostable multivibrator 58 with a current limited output is formed by transistors 60, 61, 62, 63 and 64. The emitter electrodes 60a and 64a of NPN transistors 60 and 64, respectively, are connected to negative supply bus 41, while the emitter electrode 61a of NPN transistor 61 is connected to ground bus 42. The emitter electrode 62a of PNP transistor 62 is connected directly to positive supply bus 40, while the emitter electrode 63a of PNP transistor 63 is connected to positive supply bus 40 through a parallel combination of an emitter resistance $R_8$ and an emitter capacitance $C_7$. The base electrode 60b of first multivibrator transistor 60 is coupled by a resistance $R_9$ to the phototransistor collector electrode 52a. The collector electrode 60c of transistor 60 is coupled to a first terminal of a timing capacitance $C_8$; the remaining terminal of $C_8$ is connected to the base electrode 64b of transistor 64, and to a parallel combination of a pull-down resistor $R_{10}$ and a reverse-voltage-protection diode $D_4$, between the base electrode 64b and the negative supply bus 41. Transistor collector electrode 60c is also connected, via a collector resistance $R_{11}$ to positive supply bus 40, and to the anode of a diode $D_5$, having its cathode connected to the base electrode 61b of transistor 61. Base electrode 61b is connected via a pull-down resistance $R_{12}$ to ground bus 42. The collector electrode 61c of transistor 61 is connected via a series pair of resistances $R_{13}$ and $R_{14}$ to positive potential bus 40. The base electrode 62b of transistor 62 is connected to the junction between resistances $R_{13}$ and $R_{14}$. The collector electrode 62c is connected via a resistance $R_{15}$ to the collector electrode 64c of transistor 64. The junction between transistor collector electrode 62c and resistance $R_{15}$ is connected both to the base electrode 63b of a second current source transistor 63, and to the cathode end of another diode stack $D_6$. The current source transistor collector electrode 63c is connected to a turn-off node A which is connected to negative potential bus 41 via a paralleled pair of series resistance dividers, respectively comprised of resistances $R_{16}$ and $R_{17}$, and resistances $R_{18}$ and $R_{19}$. The junctions between resistances $R_{16}$ and $R_{17}$, and between resistances $R_{18}$ and $R_{19}$, are respectively connected to the respective base electrodes 66a and 68a of transistors 66 and 68. The emitter electrodes 66b and 68b of respective transistor 66 and 68 are both connected to negative supply bus 41. The collector electrode 68c of transistor 68 is connected to the junction of transistor collector electrode 47a, transister base electrode 45c and the anode of diode stack $D_2$. The collector 66c of transistor 66 is connected to the junction of resistances $R_1$ and $R_2$, capacitance $C_4$, the anode electrode of diode stack $D_1$ and base-drive circuit output terminal 17a''.

In operation, it is initially assumed that there is no flow of current into LED 56 of opto-isolator 54, whereby phototransistor 52 is in the cut-off condition. The magnitude of resistances $R_6$, $R_7$ and $R_9$ are chosen such that, with phototransistor 52 off, transistors 50 and 60 are saturated. The saturation of transistor 50 pulls the collector electrode 50a thereof to the negative supply bus; the negative jump in voltage is coupled to the first current source base electrode 47c, by the paralleled resistance $R_4$ and speed-up capacitor $C_6$. Diode stack $D_3$ is forward-biased and the voltage drop therethrough holds base electrode 47c to a voltage below the positive potential on bus 40. Transistor 47 conducts and the voltage across its emitter resistance $R_3$ is equal to the number of diodes drops in diode stack $D_3$ less the base-emitter voltage of transistor 47. In the illustrated embodiment, the voltage across emitter resistance $R_3$ is approximately two diode voltage drops. The number of diode voltage drops and the magnitude of emitter resistance $R_3$ determine the current into transistor emitter electrode 47b. Paralleled capacitance $C_5$ is a pulse-shaping capacitor allowing current source transistor 47 to not only turn on quickly but to also have a higher current at the current-source output (collector electrode 47a) at the beginning of the conduction period of current-source transistor 47. The current from source transistor 47 turns on driver transistor 45 and current at the emitter electrode 45b thereof is supplied to the base electrode 15c of the controlled switching device 15, via base-current-determining resistor $R_2$ and its paralleled speed-up capacitance $C_4$. The magnitude of current flowing into base electrode 15c is sufficient to place device 15 in the highly-conducting condition, as at time $t_0$ of FIG. 3.

As previously mentioned hereinabove, transistor 60 was also placed in the saturated condition by the removal of current flow through LED 56, whereby the voltage at collector electrode 60c is pulled down to the negative voltage on negative supply bus 41. Transistors 61, 62, 63 and 64 are turned off, whereby current does not flow into node A and transistors 66 and 68 remain in the off condition.

At time $t_1$, when switching device 15 is to be turned off and the resonant fly-back action of the power supply begun (to cause a pulse of current to flow to the load magnetron) a current pulse is introduced at base drive input terminals 17b and through LED 56. The resulting pulse of light is coupled to phototransistor 52, which saturates. The collector electrode 52a is pulled down to the negative voltage ($-V'$) at negative supply rail 41. Transistor 50 is turned off, turning off current source transistor 47, which in turn turns off transistor 45. Resistor $R_1$, connected between base electrode 15c of the switching transistor and the negative supply bus, draws some of the switching transistor 15 stored charge therefrom to commence turning-off of the switching transistor.

It is desirable to rapidly turn switching transistor 15 off, to prevent excessive energy dissipation therein.

Therefore, the appearance of negative voltage at phototransistor collector 52a, at time $t_1$, turns off multivibrator input transistor 60. The voltage across timing capacitor $C_8$ was previously about zero volts and cannot change instantaneously. Accordingly, the voltage at input transistor collector electrode 60c and the base electrode 64b of transistor 64, both jump to a positive voltage. Simultaneously, collector electrode 64c is switched to the negative supply bus operating potential of $-V'$ volts, current flows through resistance $R_{15}$ to forward-bias diode stack $D_6$, and turns on current source transistor 63. The magnitude of current flowing into node A, from current-source transistor collector electrode 63c, is determined by the number of forward-biased diodes in diode stack $D_6$, and the magnitude of emitter resistance $R_8$. Pulse-shaping capacitor $C_7$ acts to provide rapid turn-on of the current source, as well as to provide a higher-current at the beginning of the conduction period of transistor 63. The flow of current into node A turns on both of transistors 66 and 68. Transistors 68 and 66 respectively pull the base electrode 45c of driver transistor 45, and the base electrode 15c of the switching transistor 15, both to the negative supply voltage on rail 41, whereby driver transistor 45 ceases pumping charge into the switching transistor and the charge stored in the base circuit of the switching transistor is rapidly removed therefrom by transistor 66. Thus, essentially, as soon as a pulse of current is received by LED 56, transistor 15 is turned off in as rapid a manner as possible, initiating the resonant fly-back action of the power supply.

As previously mentioned, upon receipt of a current pulse by LED 56, transistor 60 is cut off and the collector electrode voltage thereof jumps to a voltage more positive than the negative voltage on negative supply bus 41. The voltage across timing capacitor $C_8$ was initially zero volts, but gradually increases toward $+V$ volts. When series diode $D_5$ is forward-biased transistor 61 is turned on, turning off transistor 63. Thereafter, transistor 64 is eventually brought out of conduction at some time after the turn-off time $t_1$ at which the turn-off pulse appeared at the photocoupler. When transistor 64 reaches cut-off, current flow through resistance $R_{15}$ ceases and current-source transistor 63 is cut-off, removing drive at node A and returning transistors 66 and 68 to the cut-off condition. The time interval, established by the magnitude of timing capacitor $C_8$, during which current source transistor 63 operates, is selected to achieve rapid turn-off of switching device 15. At the cessation of operation of current-source transistor 63, the reverse current flow through the base-emitter junction of switching device 15, caused by the connection of resistance $R_1$ between the negative potential bus 41 and switching device base electrode 15c, is sufficient to keep switching transistor 15 in the cut-off condition, until the current flowing through LED is again removed to supply a turn-on current to the switching transistor base electrode, at the start of the next cycle of the fly-back power supply (e.g. at time $t_5$ of FIG. 3).

Figure 5:
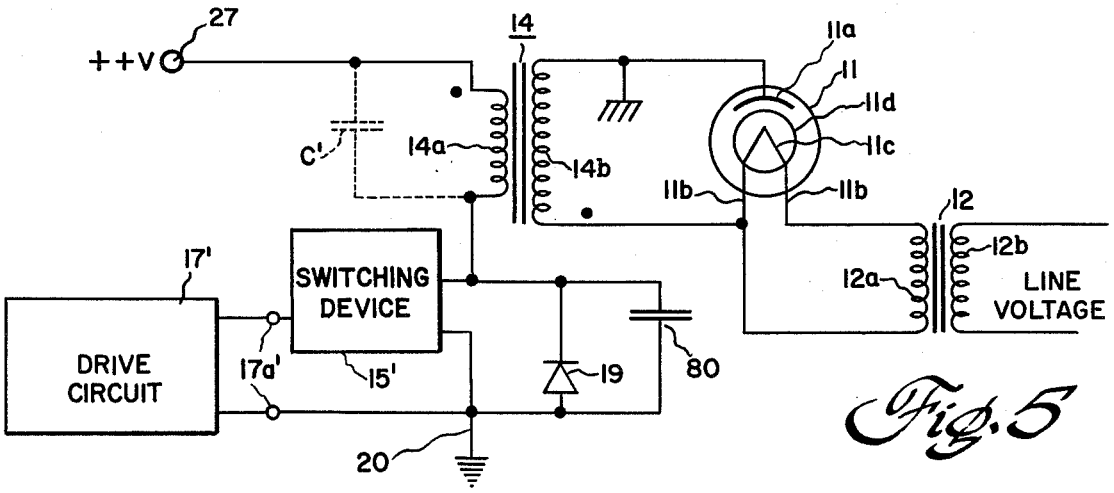
FIG. 5 is a second presently preferred embodiment of a power supply for supplying operational power to a microwave oven magnetron and the like loads.

Referring now to FIG. 5, wherein like elements have like reference designations, in the event that the capacitance C' across transformer secondary winding 14b is insufficient to reflect back as an equivalent capacitance resonating with the mutual inductance across primary winding 14a of the transformer, an additional resonating capacitance 80 is utilized across the controlled-current collector-emitter electrode circuit of switching device 15. Thus, the resonating capacitance can be: the equivalent capacitance C' reflected from the primary winding from the secondary winding (including the load); capacitance 80 effectively across the primary winding; or a combination of the two. Switching device 15' may be the transistor of the FIG. 1 embodiment, having a controlled-current path controlled by the current flow at the output 17a' of drive circuit 17', or may be a device, such as a gate-turn-off switch, power FET and the like, which has current flow in the path in series with the transformer primary winding controlled by a voltage applied to a device input by the output 17a' of drive circuit 17'.

In this embodiment, the voltage across capacitance 80, in the time interval between time $t_0$ and time $t_1$, while switching transistor 15 is saturated, is essentially zero volts. During this time interval the current in the mutual inductance of transformer 14 linearly increases and, at time $t_1$, switching device 15 is turned off. The current flowing through primary winding must be continuous and therefore flows into the resonating capacitance e.g. capacitor 80, capcitor C' or the parallel combination of capacitors C' and 80, causing ringing to commence. A high voltage pulse is generated across secondary winding 14b to drive the magnetron load into conduction, clamping the primary winding voltage. As the energy stored in transformer 14 is depleted by conduction of the load, the transistor collector voltage attempts to swing negative and is clamped substantially to zero volts by catching diode 19, at which time another cycle of the power supply is commenced by application of a next subsequent turn-on current, and/or voltage drive pulse to the switching device from base drive circuit 17'.

The present invention has been described with reference to several presently preferred embodiments thereof. Many variations and modifications will now become apparent to those skilled in the art. It is my intent, therefore, to be limited only by scope of the impending claims and not by the specific detailed embodiments described herein.

What is claimed is:

1. A power supply for energizing a self-rectifying load, through which a current flows only when a voltage of predetermined polarity and magnitude is exceeded thereacross, comprising:

source means for providing an operating potential;

a transformer having a single high-voltage secondary winding connected directly across said load and having an untapped primary winding having a mutual inductance to said secondary winding;

a switching device having a controlled-current path coupled, as the only controllable device, in electrical series connection with said transformer primary winding across the operating potential of said source means, said switching device having an input terminal for receiving a periodic signal controlling the flow of current in said controlled-current path and said primary winding;

unidirectional current flow means connected in parallel with said controlled-current path of said switching device for conducting to prevent a flow of current through the controlled-current path of said switching device in a reverse direction and for preventing application of voltages of improper polarity across said switching device;

an electrical capacitance effectively connected in parallel across the mutual inductance of said transformer and resonant therewith at a predetermined first frequency; and circuit means for driving the input of said switching device with said periodic signal of magnitude sufficient to cause said controlled-current path to heavily conduct a flow of current therethrough commencing while said unidirectional current flow means is conducting and continuing during a first portion of a predetermined time interval; said circuit means providing said periodic signal at a second frequency less than said first frequency and causing said signal to terminate to abruptly end the flow of current through said controlled-current path at the end of said time interval first portion, to cause said capacitance to charge and apply a voltage aross said load causing said load to periodically conduct a flow of current therethrough at said second frequency and during another portion of said time interval after said first portion.

2. The power supply of claim 1, wherein said capacitance is a capacitance associated with said load and reflected back to said primary winding of said transformer.

3. The power supply of claim 1, wherein said capacitance is physically connected in parallel with the controlled current path of said switching device.

4. The power supply of claim 1, wherein said capacitance is the paralleled combination of a first capacitance physically connected in parallel with the controlled-current path of said switching device and a second capacitance associated with said load and reflected back to said transformer primary winding.

5. The power supply of claim 1, wherein said unidirectional current flow means include a diode element connected across said switching device controlled-current path.

6. The power supply of claim 5, further including a snubber circuit in parallel with said diode element.

7. The power supply of claim 6, wherein said snubber circuit comprises a series combination of a resistance and a capacitance.

8. The power supply of claim 1, wherein said load is a magnetron microwave power generator.

9. The power supply of claim 1, wherein said means for driving the input of said switching device includes:

a first current-controlled switching element for providing a flow of current into said switching device input terminal;

a second current-controlled switching element connected to said switching device input terminal for withdrawing charge stored in said switching device;

input means for receiving an input signal having a first state at the start of said time interval and a second state at a time during said time interval prior to the time said load is to conduct;

first means including a current source enabled only by said input signal first state for providing sufficient control current to turn on said first switching element to turn said switching device to the highly-conductive condition; and second means connected to said input means and responsive only to said second state for assuring said first switching element is disabled and including a monostable multivibrator having a constant current output connected to provide sufficient control current for enabling said second switching element to rapidly remove the charge stored in said switching device to rapidly turn off said switching device.

10. The power supply of claim 1, wherein said circuit means controls the duration of said predetermined time interval to control the magnitude of power consumed by said load.

* * * * *